US009105985B2

(12) United States Patent
Liu et al.

(10) Patent No.: US 9,105,985 B2
(45) Date of Patent: Aug. 11, 2015

(54) ANTENNA SYSTEM FOR MOBILE COMMUNICATION AND ANTENNA MODULE THEREOF

(71) Applicant: AUDEN TECHNO CORP., Taoyuan County (TW)

(72) Inventors: Hsien-Wen Liu, New Taipei (TW); Yi-Hsin Chiu, New Taipei (TW)

(73) Assignee: AUDEN TECHNO CORP., Taoyuan County (TW)

( * ) Notice: Subject to any disclaimer, the term of this patent is extended or adjusted under 35 U.S.C. 154(b) by 212 days.

(21) Appl. No.: 13/959,685

(22) Filed: Aug. 5, 2013

(65) Prior Publication Data

US 2015/0035708 A1 Feb. 5, 2015

(51) Int. Cl.
*H01Q 1/32* (2006.01)
*H01Q 25/00* (2006.01)

(52) U.S. Cl.
CPC ..... *H01Q 25/001* (2013.01); *H01Q 1/3216* (2013.01)

(58) Field of Classification Search
USPC ..... 343/711, 713, 725, 727, 841
See application file for complete search history.

(56) References Cited

U.S. PATENT DOCUMENTS

| | | | | |
|---|---|---|---|---|
| 3,594,802 | A * | 7/1971 | Koob | 343/705 |
| 8,009,107 | B2 * | 8/2011 | Li et al. | 343/700 MS |
| 2007/0279304 | A1 * | 12/2007 | Chakam et al. | 343/713 |
| 2013/0141299 | A1 * | 6/2013 | Mast et al. | 343/786 |

* cited by examiner

*Primary Examiner* — Tan Ho
(74) *Attorney, Agent, or Firm* — Li & Cai Intellectual Property (USA) Office

(57) ABSTRACT

An antenna system for mobile communication includes a transportation device and an antenna module installed on the transportation device. The antenna module has a first polarized antenna unit and a second polarized antenna unit. The polarized direction of first polarized antenna unit is perpendicular to the polarized direction of second polarized antenna unit, such that when the transportation device moves along a first direction, the first and the second polarized antenna units are coupling to each other, and each has an 8-shaped radiation pattern. The longitudinal direction of the radiation pattern of the first polarized antenna unit and the longitudinal direction of the radiation pattern of the second polarized antenna unit are parallel to a second direction, and the second direction is not parallel to the first direction. Thus, the instant disclosure provides the antenna system capable of restraining the multipath fading of mobile communication.

10 Claims, 4 Drawing Sheets

ANTENNA SYSTEM FOR MOBILE COMMUNICATION AND ANTENNA MODULE THEREOF

BACKGROUND OF THE INVENTION

1. Field of the Invention

The instant disclosure relates to an antenna system; more particularly, to an antenna system for mobile communication and an antenna module, which are capable of restraining the multipath fading.

2. Description of Related Art

High-speed train providing a network communication service is the future trend. If the network communication service includes Internet communication service by the antenna design during high speed movement, the antenna must overcome the multipath fading, which is raised from the high speed movement. That is to say, when the transportation device moving at high speed, the conventional antenna structure cannot effectively restrain the multipath fading, and therefore cannot provide a stable broadband service.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides an antenna system for a mobile communication and an antenna module, which are capable of effectively restraining the multipath fading of the mobile communication by using a dual-polarized antenna structure.

The antenna system for a mobile communication, comprises: a transportation device; and an antenna module disposed on the transportation device and having a first polarized antenna unit and a second polarized antenna unit, wherein a polarized direction of the first polarized antenna unit is perpendicular to a polarized direction of the second polarized antenna unit, wherein when the transportation device moves along a first direction, each one of the first and the second polarized antenna units has an 8-shaped radiation pattern by the first and the second polarized antenna units coupling with each other, and wherein a longitudinal direction of the radiation pattern of the first polarized antenna unit and a longitudinal direction of the radiation pattern of the second polarized antenna unit are substantially parallel to a second direction, the second direction is non-parallel to the first direction.

The antenna module of an antenna system for a mobile communication and installing on a transportation device, comprises: a first polarized antenna unit; and a second polarized antenna unit having a polarized direction perpendicular to a polarized direction of the first polarized antenna unit for causing each one of the first and the second polarized antenna units to have an 8-shaped radiation pattern during the movement of the transportation device; wherein an longitudinal direction of the radiation pattern of the first polarized antenna unit and an longitudinal direction of the radiation pattern of the second polarized antenna unit are substantially perpendicular to a moving direction of the transportation device for restraining a multipath fading generated from the movement of the transportation device.

Base on the above, the antenna system for the mobile communication and the antenna module in the instant disclosure depend on the first and the second polarized antenna units, which are orthogonally polarized with each other, to effectively restrain the multipath fading of the mobile communication and increase the data transmission efficiency and stability for providing a stable broadband service.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

Figure 1:
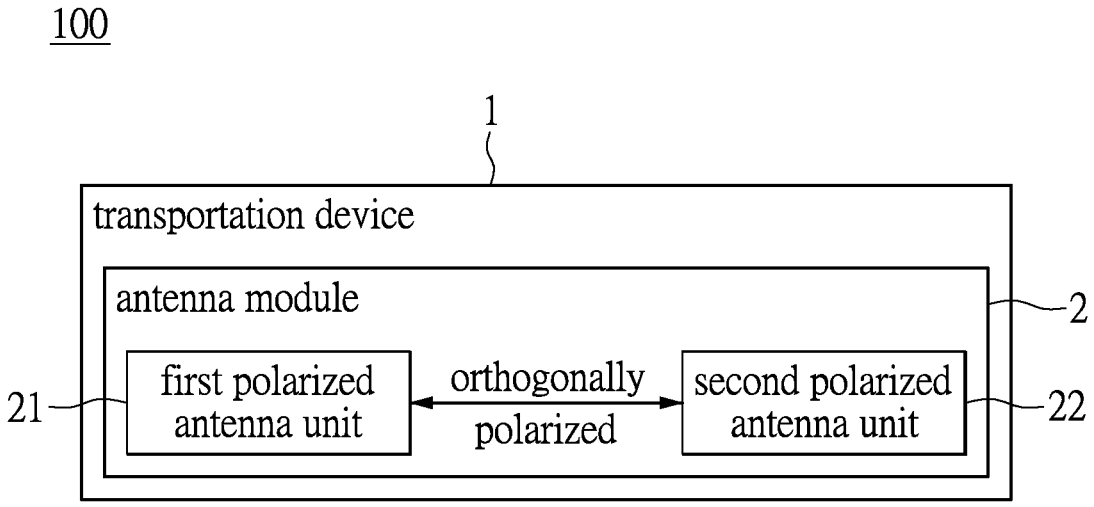
FIG. 1 is a functional block view of an antenna system for a mobile communication according to the instant disclosure.
Figure 2:
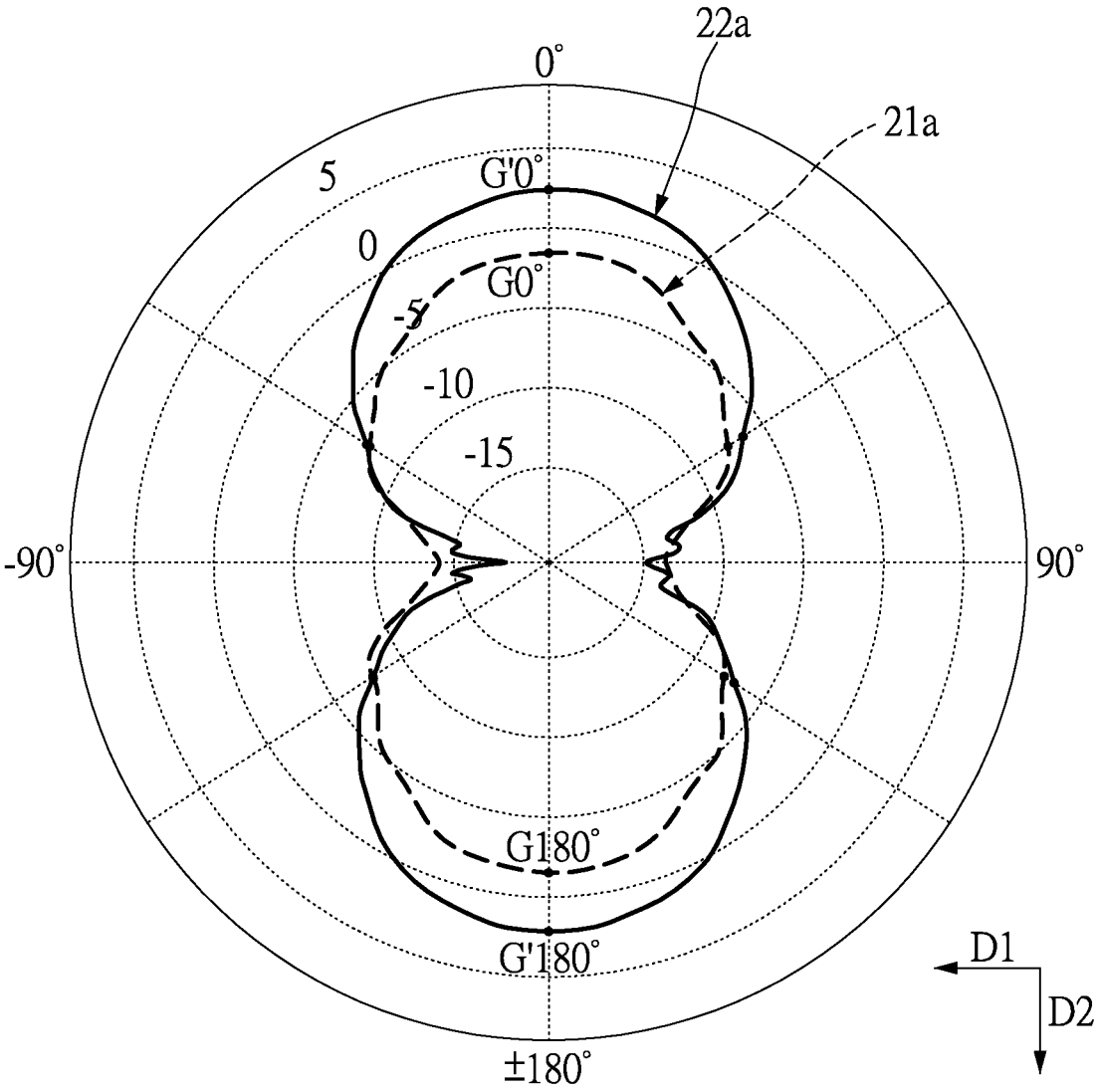
FIG. 2 is a planar radiation pattern diagram of the antenna system according to the instant disclosure.

Please refer to FIGS. 1 and 2, which show an embodiment of the instant disclosure. The instant embodiment provides an antenna system 100 for a mobile communication. The antenna system 100 includes a transportation device 1 and an antenna module 2 disposed on the transportation device 1. The transportation device 1 can be a railroad car of Mass Rapid Transit (MRT) or the other device capable of the transporting function. The transportation device 1 is movable along a first direction D1, and the first direction D1 is changeable according to the topography and the moving route. That is to say, the first direction D1 is not limited to a linear direction.

The antenna module 2 includes a first polarized antenna unit 21 and a second polarized antenna unit 22. A polarized direction of the first polarized antenna unit 21 is perpendicular to a polarized direction of the second polarized antenna unit 22. When the transportation device 1 moves along the first direction D1, each one of the first and the second polarized antenna units 21, 22 has an 8-shaped radiation pattern 21*a*, 22*a* as shown in FIG. 2 by the first and the second polarized antenna units 21, 22 coupling with each other.

Specifically, when the transportation device 1 moves along the first direction D1, the first and the second polarized antenna units 21, 22 respectively have the 8-shaped radiation patterns 21*a*, 22*a* as shown in FIG. 2, where a longitudinal direction of the radiation pattern 21*a* of the first polarized antenna unit 21 and a longitudinal direction of the radiation pattern 22*a* of the second polarized antenna unit 22 are substantially parallel to a second direction D2. The second direction D2 is non-parallel to the first direction D 1. In particular, the second direction D2 is preferably perpendicular to the first direction D1. Thus, the dual-polarized antenna structure, which includes the first and the second polarized antenna units 21, 22, effectively restrains a multipath fading generated from the movement of the transportation device 1. A plane jointly defined by the first and the second directions D1, D2 is identical to a moving plane of the transportation device 1. That is to say, when the transportation device 1 moves on a level ground, the plane jointly defined by the first and the second directions D1, D2 is substantially parallel to the horizontal plane.

Moreover, the radiation patterns 21*a*, 22*a* of the first and the second polarized antenna units 21, 22 are located in a planar radiation pattern diagram as shown in FIG. 2. The planar radiation pattern diagram is located at the plane jointly defined by the first and the second directions D1, D2. The planar radiation pattern diagram defines a 0 degree point, a 90 degree point, a 180 degree point, and a −90 degree point, and a virtual line connecting to the 0 degree point and the 180 degree point of the planar radiation pattern diagram is substantially parallel to the longitudinal direction of the radiation pattern 21*a* of the first polarized antenna unit 21 and the longitudinal direction of the radiation pattern 22*a* of the second polarized antenna unit 22 (i.e., the second direction D2). Another virtual line connecting to the 90 degree point and the −90 degree point of the planar radiation pattern diagram is substantially parallel to the first direction D1.

In particular, when the more following features the first and the second polarized antenna units 21, 22 conforms to, the multipath fading generated from the movement of the transportation device 1 is more restrained.

The difference of the antenna gains in the 0 degree point and the 180 degree point (i.e., G0° and G180°) of the radiation pattern 21*a* of the first polarized antenna unit 21 is almost equal to 0 dB. The difference of the antenna gains in the 0 degree point and the 180 degree point (i.e., G'0° and G'180°) of the radiation pattern 22*a* of the second polarized antenna unit 22 is almost equal to 0 dB as well. To achieve better transmission performance in real application, the isolation performance between the first and the second polarized antenna units 21, 22 is smaller than or equal to −10 dB.

Figure 3:
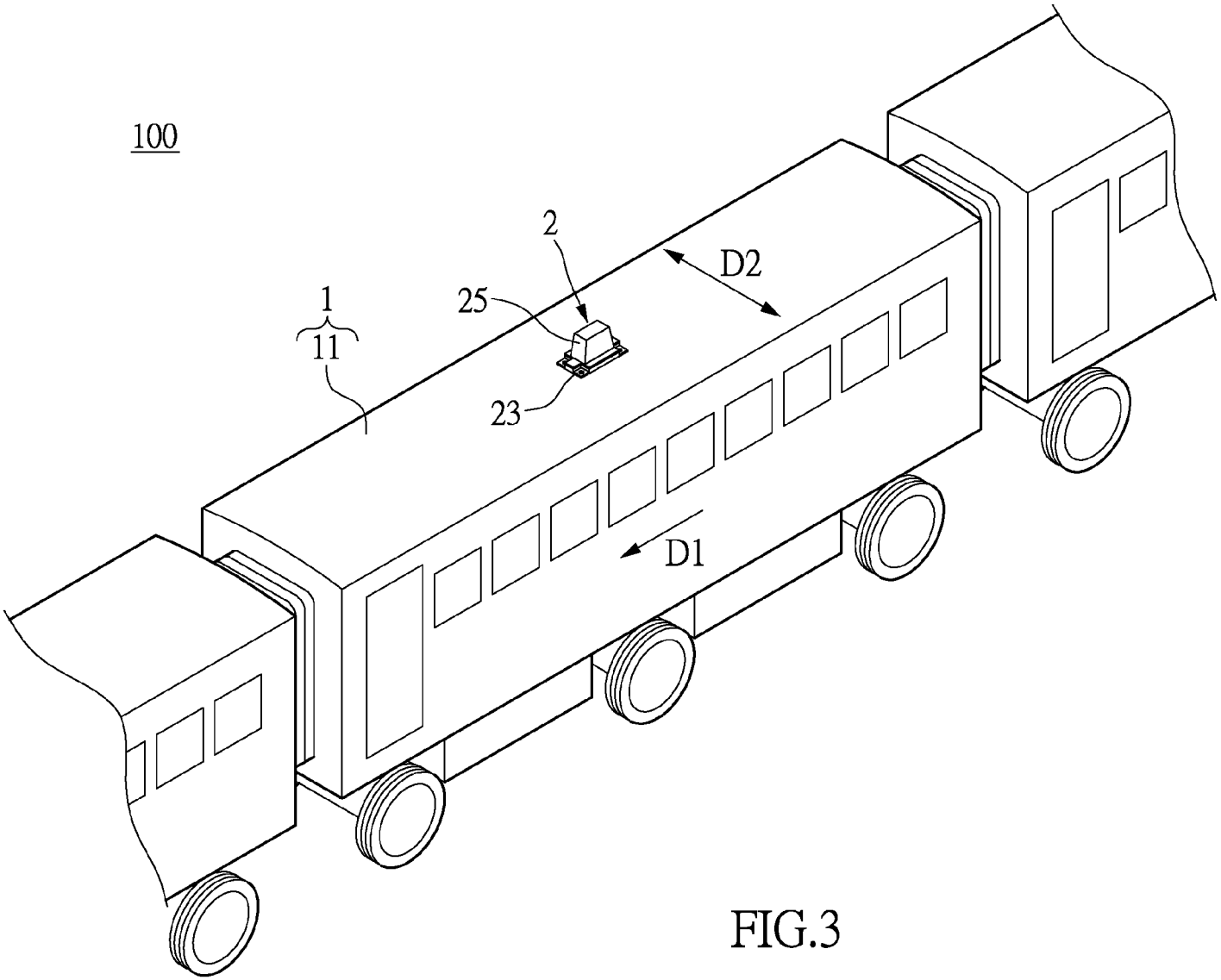
FIG. 3 is a perspective view of an embodiment of the antenna system according to the instant disclosure.

The following description takes a configuration of the antenna system 100 as shown in FIG. 3 for example, that is to say, the antenna system 100 is one of the samples, which conforms to the above features, but the antenna system 100 is not limited thereto.

Figure 4:
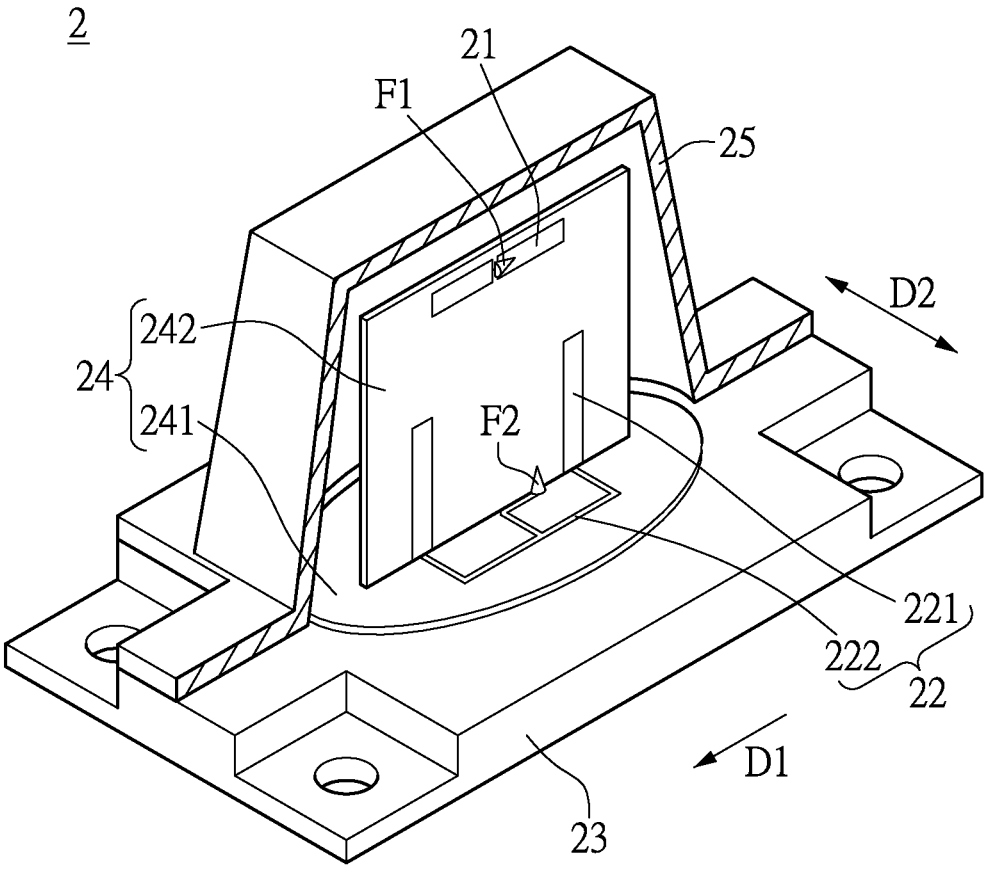
FIG. 4 is a partially sectional view of an antenna module disclosed in FIG. 3.

Please refer to FIGS. 3 and 4, which show the antenna system 100 of the instant disclosure. In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

The antenna system 100 includes a transportation device 1 (i.e., a railroad car 11) and an antenna module 2 disposed on the transportation device 1. The antenna module 2 is applied for the Worldwide Interoperability for Microwave Access (WiMax) of the fourth generation of mobile phone mobile communications standards (4G), and the bandwidth of the operating frequency of the antenna module 2 is approximately 2500~2700 MHz.

However, the applied field of the antenna module 2 is not limited to the WiMax. For example, the antenna module 2 can be applied for the other fourth generation of mobile phone mobile communications standards (e.g., Long Term Evolution), or the antenna module 2 can be applied for the second or third generation of mobile phone mobile communications standards (2G or 3G).

The antenna module 2 includes a first polarized antenna unit 21, a second polarized antenna unit 22, a fixing seat 23, a carrying unit 24, and an antenna shield 25. The fixing seat 23 is substantially an elongated plate and lain on (e.g., screwed on) the top surface of the railroad car 11, and the axis of elongation of the fixing seat 23 is substantially parallel to the axis of elongation of the railroad car 11.

The carrying unit 24 includes a bottom plate 241 and a base plate 242. The bottom plate 241 having an elliptical shape is flatly disposed on the fixing seat 23, and the relative position between the carrying unit 24 and the transportation device 1 is fixed. The contour of the bottom plate 241 is located inside the contour of the fixing seat 23, and the major axis of the elliptical bottom plate 241 is substantially parallel to the axis of elongation of the fixing seat 23. The base plate 242 having a rectangular shape is erectly fixed on the major axis of the elliptical bottom plate 241. The antenna shield 25 is a frustum shaped body, and the cross-section of the antenna shield 25, which is parallel to the bottom seat 241, is approximately rectangular. The antenna shield 25 is fixed on the fixing seat 23 and entirely covering the carrying plate 24.

The first polarized antenna unit 21 in the instant disclosure takes a horizontally polarized dipole antenna 21 for example. The second polarized antenna unit 22 in the instant disclosure takes a vertically polarized monopole antenna array 22, which has two identical monopole antennas 221 and a feeding net 222, for example.

The dipole antenna 21 and monopole antenna array 22 are formed on the carrying unit 24. Specifically, the dipole antenna 21 and the monopole antennas 221 are coplanarly formed on the base plate 242. The base plate 242 is disposed on the middle portion of the bottom plate 241 (i.e., the major axis of the elliptical bottom plate 241), so that the dipole antenna 21 and the monopole antennas 221 are perpendicular to the fixing seat 23 and arranged at the middle region of the space jointly defined by the antenna shield 25 and the fixing seat 23. Thus, the radiation patterns of the dipole antenna 21 and the monopole antennas 221 trend to have no directivity by the spatial arrangement and the coplanar arrangement.

Moreover, in order to prevent a co-polarization, which is generated from the dipole antenna 21 and the monopole antennas 221 by the narrow space (e.g., the height of the antenna shield 25) and the ground, each one of the length of the dipole antenna 21 and the length of each monopole antenna 221 is equal to a quarter wavelength, in which the wavelength is corresponding to the operating frequency of the antenna module 2, and a distance between the dipole antenna 21 and fixing seat 23 is approximately equal to 0.4 times the wavelength. In other words, the distance between the dipole antenna 21 and fixing seat 23 is greater than a max distance between each monopole antenna 221 and fixing seat 23, in which the difference between the distance and the max distance is approximately equal to 0.15 times the wavelength, but is not limited thereto. In particular, the distance between the dipole antenna 21 and any monopole antenna 221 is approximately equal to 0.1-0.2 times the wavelength. Thus, the dipole antenna 21 and the monopole antennas 221 are effectively achieved orthogonal polarization under the above conditions.

The limitations of the construction of the antenna shield 25 are corresponding to a predetermined operating frequency, and the predetermined operating frequency corresponds to a predetermined wavelength. The relationship between the construction of the antenna shield 25 and the predetermined operating frequency is disclosed as follows. The rectangular cross section of the bottom portion of the antenna shield 25 has a length and a width, in which the length is 0.78 times the predetermined wavelength and the width is 0.44 times the predetermined wavelength. The rectangular cross section of the top portion of the antenna shield 25 has a length and a width, in which the length is 0.71 times the predetermined wavelength and the width is 0.37 times the predetermined wavelength. The height of the antenna shield 25 is 0.57 times the predetermined wavelength. Specifically, when the predetermined operating frequency is 2.4 GHz, the length of the rectangular cross section of the bottom of the antenna shield 25 is 97.44 mm, the width of the rectangular cross section of the bottom of the antenna shield 25 is 55.4 mm, the length of the rectangular cross section of the top portion of the antenna shield 25 is 86.8 mm, the width of the rectangular cross section of the top portion of the antenna shield 25 is 45.8 mm, and the height of the antenna shield 25 is 71 mm.

The arrangements of the dipole antenna 21 and the monopole antenna array 22 are substantially disclosed as follows. The dipole antenna 21 is formed on the upper half portion of the base plate 242, and the dipole antenna 21 is parallel and adjacent to the top edge of the base plate 242. The dipole antenna 21 has a first feeding point F1 arranged on the substantially middle portion thereof. The monopole antennas 221 are formed on the lower half portion of the base plate 242, and the monopole antennas 221 are respectively parallel and adjacent to the opposite lateral edges of the base plate 242. The monopole antennas 221 are parallel to each other and perpendicular to the bottom plate 241.

Moreover, the feeding net 222 is formed on the bottom plate 241, and the feeding net 222 are connecting to the bottom end of each monopole antenna 221. The feeding net 222 has a second feeding point F2 arranged between the bottom ends of the monopole antennas 221. Specifically, the feeding net 222 is approximately E-shaped and includes three end points, which are the right ends of the E-shape. The middle end point of the E-shaped feeding net 222 extends to connect to the second feeding point F2, and the other end points are respectively connecting to the bottom ends of the monopole antennas 221.

In particular, the distance between the monopole antennas 221 is identical to half of the wavelength corresponding to the operating frequency of the antenna module 2. The distance between the inner surface of the antenna shield 25 and the dipole antenna 21 (or the monopole antenna array 22) can be adjusted by the designer's request for preventing the problems such as frequency deviation or reduction.

Accordingly, the polarized direction of the dipole antenna 21 and the polarized direction of the monopole antenna array 22 are perpendicular to each other by the construction design of the antenna module 2, such that when the railroad car 11 moves along the first direction D1, each one of the dipole antenna 21 and the monopole antenna array 22 can generate the 8-shaped radiation pattern (such as FIG. 2), and the longitudinal direction of the radiation pattern of the dipole antenna 21 is at least partially overlapping the longitudinal direction of the radiation pattern of the monopole antenna array 22. Moreover, the test results of the dipole antenna 21 and the monopole antenna array 22 by testing the antenna system 100 are disclosed in the following tables 1-3.

TABLE 1 test result of the dipole antenna by testing the antenna system

| | first polarized antenna unit (dipole antenna) | | | |
|---|---|---|---|---|
| operating frequency (MHz) | 2500 | 2550 | 2600 | 2690 |
| resistance of antenna (Ω) | 50 | | | |
| return loss (dB) | −13.31 | −15 | −19 | −19.27 |
| polarized of antenna | horizontally polarized | | | |

TABLE 2 test result of the monopole antenna array by testing the antenna system

| | second polarized antenna unit (monopole antenna array) | | | |
|---|---|---|---|---|
| operating frequency (MHz) | 2500 | 2550 | 2600 | 2690 |
| resistance of antenna (Ω) | 50 | | | |

TABLE 2-continued test result of the monopole antenna array by testing the antenna system

| | second polarized antenna unit (monopole antenna array) | | | |
|---|---|---|---|---|
| return loss (dB) | −11.85 | −12.04 | −13.2 | −10.27 |
| polarized of antenna | vertically polarized | | | |

TABLE 3 test result of the dual-polarized antenna structure by testing the antenna system

| | dual-polarized antenna structure | | | |
|---|---|---|---|---|
| operating frequency (MHz) | 2500 | 2550 | 2600 | 2690 |
| isolation performance (dB) | −36.21 | −32.99 | −33.33 | −35.02 |
| far-field envelope coefficient | 0.0006 | 0.0005 | 0.0005 | 0.0019 |

When the transportation device 1 moves in high speed, the antenna module 2 can effectively restrain the multipath fading of the mobile communication by the structural design of the antenna system 100, and the antenna module 2 further has better data transmission efficiency and stability for providing a stable broadband service.

In addition, the antenna module 2 in the instant embodiment takes the configuration as shown in FIG. 4 for example, but the antenna module 2 can be adjusted by the designer's request. For example, in an another embodiment (not shown), the antenna module 2 excludes the bottom plate 241 and the feeding net 222 is formed on the base plate 242; or, the first polarized antenna unit 21 and the second polarized antenna unit 22 are respectively formed on two base plates 242; or, the first polarized antenna unit 21 and the second polarized antenna unit 22 are adapted in the other antenna types excluding the dipole antenna or the monopole antenna array.

[The Possible Effect of the Instant Disclosure]

In summary, the antenna system of the mobile communication in the instant disclosure depends on the orthogonal polarization of the first and the second polarized antenna units capable of the 8-shaped radiation patterns, the high isolation performance, and low relative coefficient, to effectively restrain the multipath fading of the mobile communication for increasing the data transmission efficiency when the antenna module in high speed movement. Moreover, the test results of the antenna module by testing the antenna system are objectively disclosed that the antenna module has better data transmission efficiency and stability for providing a stable broadband service.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An antenna system for a mobile communication, comprising:

a transportation device; and an antenna module disposed on the transportation device and having a first polarized antenna unit and a second polarized antenna unit, wherein a polarized direction of the first polarized antenna unit is perpendicular to a polarized direction of the second polarized antenna unit, wherein when the transportation device moves along a first direction, each one of the first and the second polarized antenna units has an 8-shaped radiation pattern by the first and the second polarized antenna units coupling with each other, and wherein a longitudinal direction of the radiation pattern of the first polarized antenna unit and a longitudinal direction of the radiation pattern of the second polarized antenna unit are substantially parallel to a second direction, the second direction is non-parallel to the first direction.

2. The antenna system as claimed in claim 1, wherein the second direction is substantially perpendicular to the first direction, and a plane jointly defined by the first and the second directions is identical to a moving plane of the transportation device.

3. The antenna system as claimed in claim 2, wherein the radiation patterns of the first and the second polarized antenna units are located in a planar radiation pattern diagram, and wherein the planar radiation pattern diagram is located at the plane jointly defined by the first and the second directions, the planar radiation pattern diagram defines a 0 degree point and a 180 degree point, a virtual line connecting to the 0 degree point and the 180 degree point of the planar radiation pattern diagram is substantially parallel to the longitudinal direction of the radiation pattern of the first polarized antenna unit and the longitudinal direction of the radiation pattern of the second polarized antenna unit.

4. The antenna system as claimed in claim 1, wherein the first polarized antenna unit has a dipole antenna, the second polarized antenna unit has a monopole antenna array, the polarized direction of the dipole antenna is perpendicular to the polarized direction of the monopole antenna array for causing each one of the dipole antenna and the monopole antenna array to have the 8-shaped radiation pattern when the transportation device moves along the first direction.

5. The antenna system as claimed in claim 4, wherein the monopole antenna array has two monopole antennas, each one of the length of the dipole antenna and the length of each monopole antenna is equal to a quarter wavelength, and wherein the wavelength is corresponding to an operating frequency of the antenna module, a distance between the dipole antenna and any monopole antenna is approximately equal to 0.1-0.2 times the wavelength.

6. The antenna system as claimed in claim 5, wherein the antenna module has a fixing seat and an antenna shield disposed on the fixing seat, the dipole antenna and the monopole antennas are in coplanar arrangement and arranged in a space jointly defined by the antenna shield and the fixing seat, and wherein the dipole antenna and the monopole antennas are perpendicular to the fixing seat and arranged at the middle region of the space jointly defined by the antenna shield and the fixing seat.

7. The antenna system as claimed in claim 4, wherein the antenna module further has a carrying unit, the dipole antenna and the monopole antenna array are formed on the carrying unit, the relative position between the transportation device and the carrying unit is fixed.

8. The antenna system as claimed in claim 4, wherein the dipole antenna has a first feeding point, the monopole antenna array includes two monopole antennas and a feeding net having a second feeding point, the feeding net is connecting to the monopole antennas.

9. The antenna system as claimed in claim 4, wherein the longitudinal direction of the radiation pattern of the dipole antenna at least partially overlaps the longitudinal direction of the radiation pattern of the monopole antenna array.

10. An antenna module of an antenna system for a mobile communication and installing on a transportation device, the antenna module comprising:

a first polarized antenna unit; and a second polarized antenna unit having a polarized direction perpendicular to a polarized direction of the first polarized antenna unit for causing each one of the first and the second polarized antenna units to have an 8-shaped radiation pattern during the movement of the transportation device;

wherein an longitudinal direction of the radiation pattern of the first polarized antenna unit and an longitudinal direction of the radiation pattern of the second polarized antenna unit are substantially perpendicular to a moving direction of the transportation device for restraining a multipath fading generated from the movement of the transportation device.

* * * * *